US007604502B2

(12) United States Patent
Pan

(10) Patent No.: US 7,604,502 B2
(45) Date of Patent: Oct. 20, 2009

(54) ELECTRICAL CONNECTOR HAVING IMPROVED SHIELDING MEANS

(75) Inventor: Feng Pan, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/316,272

(22) Filed: Dec. 11, 2008

(65) Prior Publication Data

US 2009/0149065 A1 Jun. 11, 2009

(30) Foreign Application Priority Data

Dec. 11, 2007 (CN) ..... 2007 1 0191293

(51) Int. Cl.
*H01R 13/648* (2006.01)

(52) U.S. Cl. ..... 439/607.08

(58) Field of Classification Search ..... 439/607.08, 439/607.11, 108, 701, 607.05, 901
See application file for complete search history.

(56) References Cited

U.S. PATENT DOCUMENTS 4,846,727 A 7/1989 Glover et al.
6,371,813 B2 * 4/2002 Ramey et al. ..... 439/607.11
6,602,095 B2 8/2003 Astbury, Jr. et al.
6,872,085 B1 3/2005 Cohen et al.
6,899,566 B2 5/2005 Kline et al.
7,094,102 B2 * 8/2006 Cohen et al. ..... 439/607.08
7,278,886 B2 * 10/2007 Cohen et al. ..... 439/607.08
7,513,797 B2 * 4/2009 Scherer et al. ..... 439/607.05

* cited by examiner

*Primary Examiner*—Chandrika Prasad
(74) *Attorney, Agent, or Firm*—Ming Chieh Chang; Wei Te Chung; Andrew C. Cheng

(57) ABSTRACT

An electrical connector (1) includes an insulative base (10) and a number of shielding plates retained in the insulative base. The shielding plates include a number of first and second shielding plates (30, 40) arranged in parallel arrangement. Each first shielding plate extends along a first direction and includes a number of tail portions (33) for attaching to a printed circuit board. Each second shielding plate extends along the first direction and is disposed adjacent to the first shielding plate. The second shielding plate includes a number of connecting portions (43) connected to the adjacent first shielding plate. A number of columns of pins (20) are received in the insulative base. Each column of pins arranges along the first direction and is disposed between the first shielding plate and the second shielding plate.

10 Claims, 6 Drawing Sheets

ELECTRICAL CONNECTOR HAVING IMPROVED SHIELDING MEANS

BACKGROUND OF THE INVENTION

1. Field of the Invention

The present invention relates to a high density connector, and particularly to an electrical connector which is provided with an improved shielding means.

2. Description of Related Arts

Generally, the high density connector typically has a large number of contacts electrically connected to a printed circuit board for transmitting high speed signals or data. Such a conventional high density connector is disclosed in U.S. Pat. No. 6,899,566 issued on May 31, 2003. The electrical connector has an insulative housing, rows and Columns of contact pairs fastened to the insulative housing, and an array of shielding plates retained in the insulative housing for providing Electro Magnetic Interference (EMI) shielding for the contact pairs. Each contact has a tail portion for mounting on a printed circuit board. And each shielding plate also has a number of tail portions for mounting on the printed circuit board.

However, the number of the tail portions of the contacts and the shielding plates are too large. It would result in a large number of conductive paths disposed on the printed circuit board for connection of the tail portions.

Hence, an electrical connector with improved shielding plates is desired.

SUMMARY OF THE INVENTION

An object of the present invention is to provide an electrical connector including improved shielding plates having common tail portions attached to the printed circuit board.

To achieve the above object, an electrical connector includes an insulative base, and a number of first and second shielding plates retained in the insulative base and arranged in parallel arrangement. Each first shielding plate extends along a first direction and includes a number of tail portions for attaching to a printed circuit board. Each second shielding plate extends along the first direction and is disposed adjacent to the first shielding plate. The second shielding plate includes a number of connecting portions connected to the adjacent first shielding plate. A number of columns of pins are received in the insulative base. Each column of pins arranges along the first direction and is disposed between the first shielding plate and the second shielding plate.

Advantages of the present invention are to provide an electrical connector having a first shielding plate including a number of tail portions connected with a second shielding plate having no tail portion. Thus, the number of the grounding paths of the printed circuit board would be reduced.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
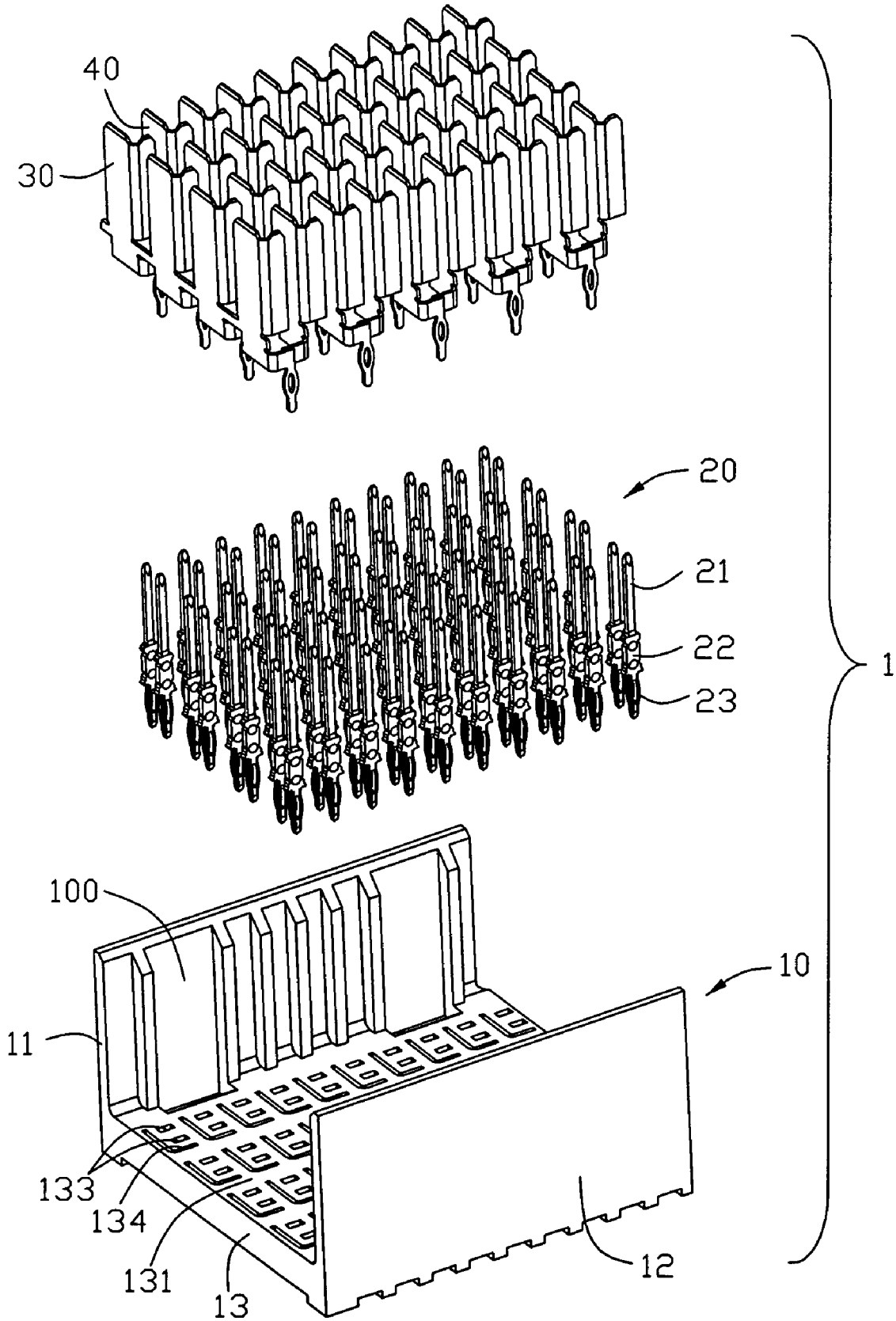
FIG. 1 is an exploded perspective view of an electrical connector of the present invention.

Reference will now be made to the drawing figures to describe the present invention in detail. Referring to FIGS. 1-6, an electrical connector 1 includes an insulative base 10, a plurality of columns of pins 20 received in the insulative base 10, a number of first shielding plates 30, and a number of second shielding plates 40 retained in the insulative base 10.

Figure 2:
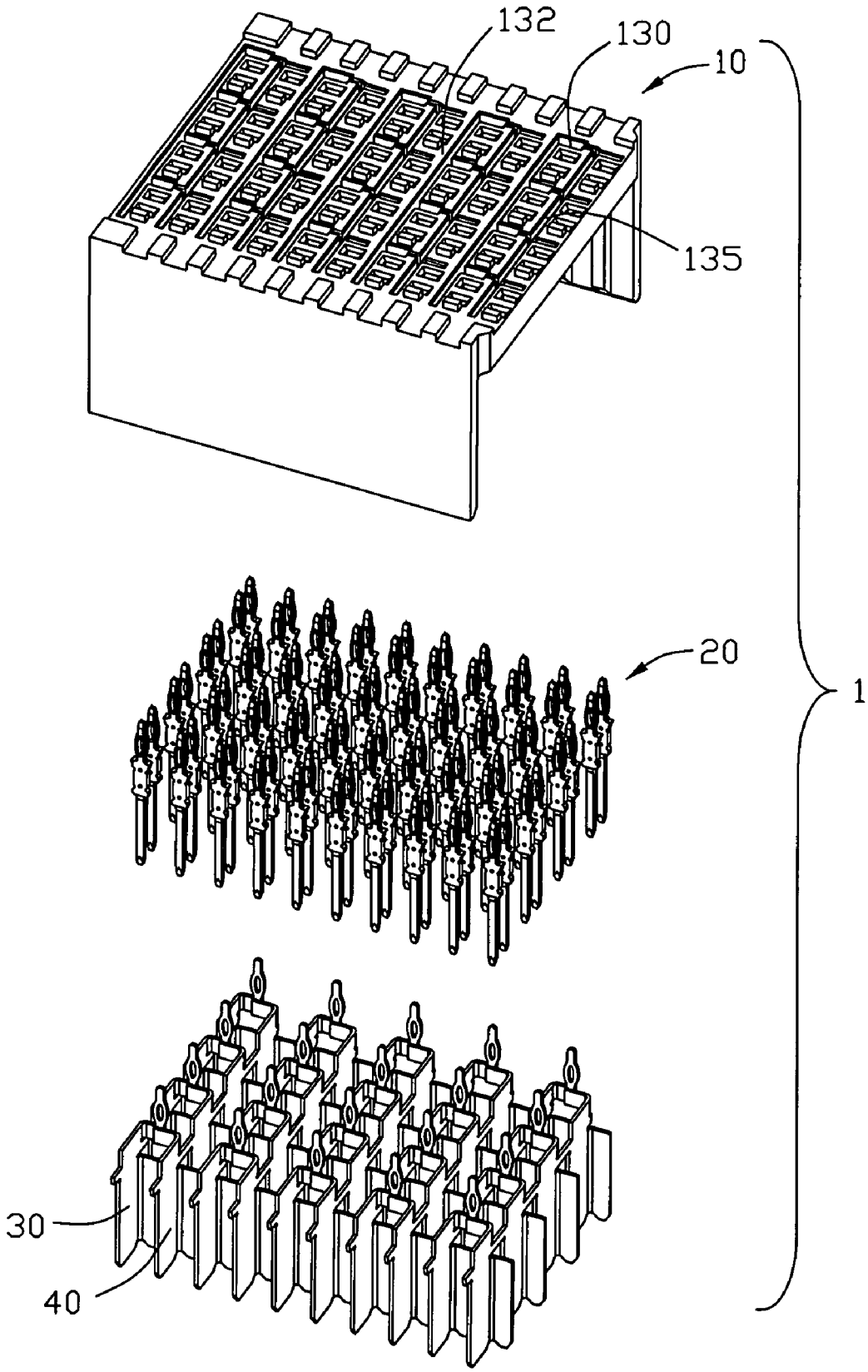
FIG. 2 is another exploded perspective view similar to FIG. 1, taken from another aspect.
Figure 3:
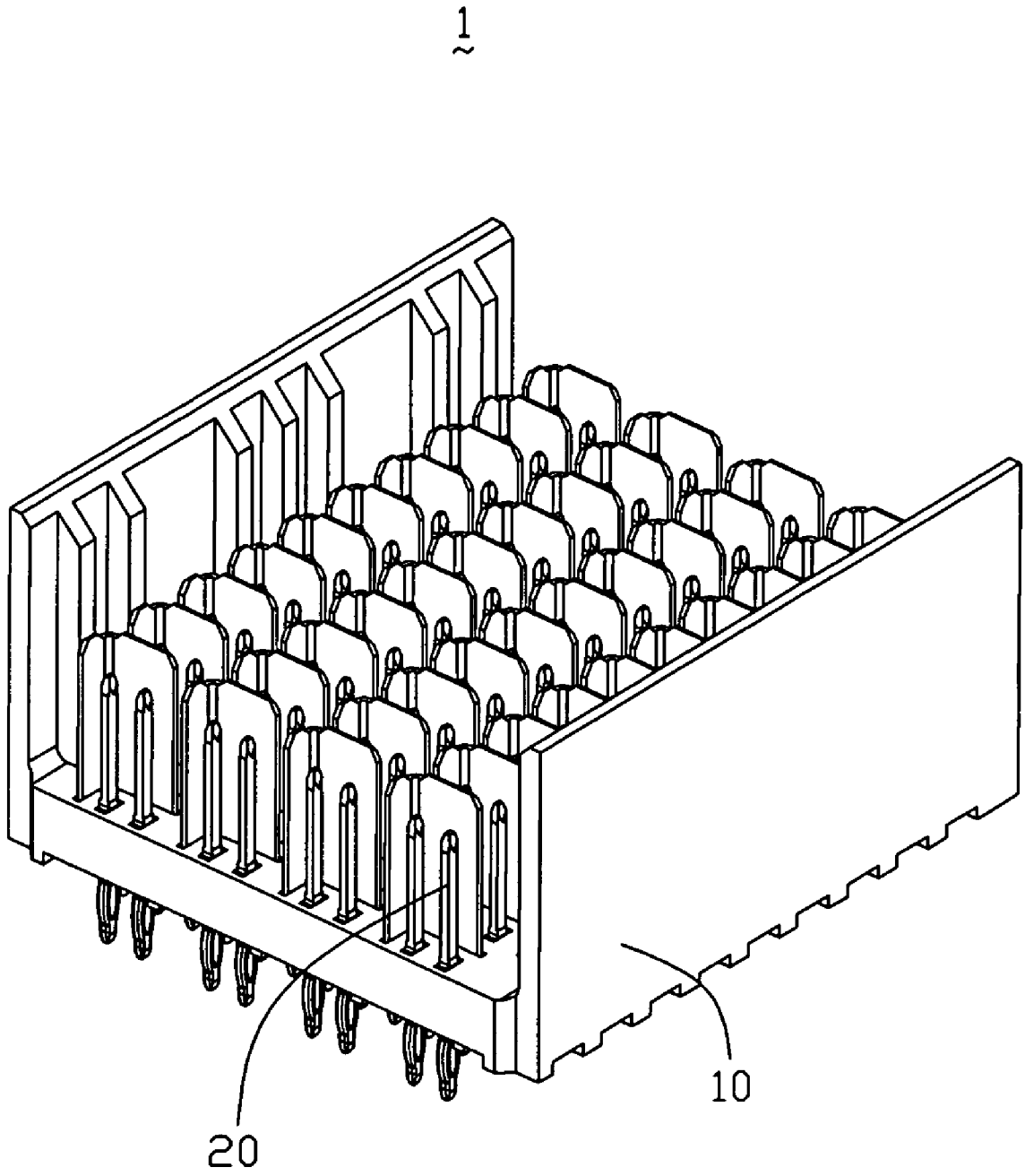
FIG. 3 is an assembled perspective view of an electrical connector as shown in FIG. 1.
Figure 4:
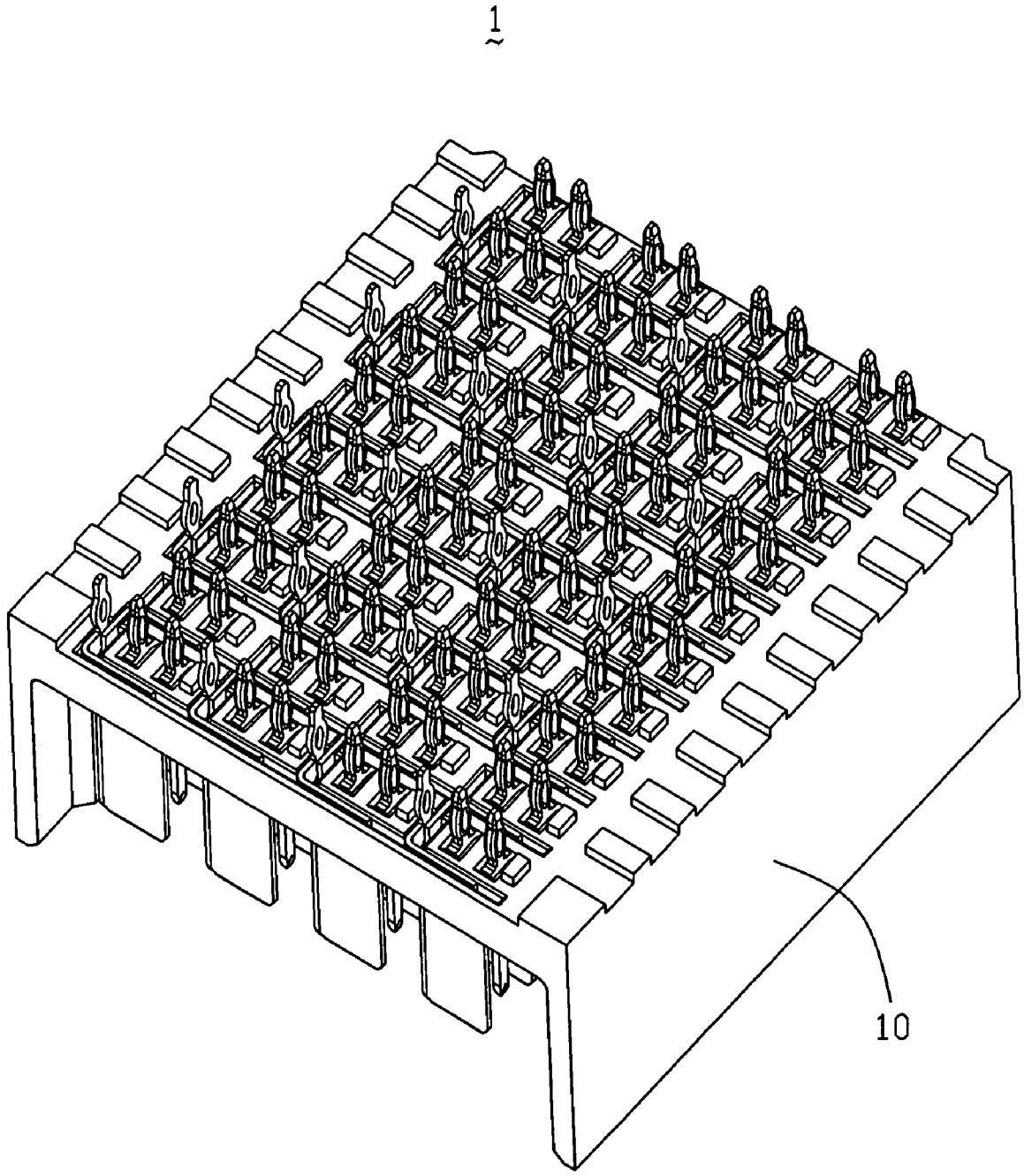
FIG. 4 is another assembled perspective view similar to FIG. 3 taken from another aspect.
Figure 5:
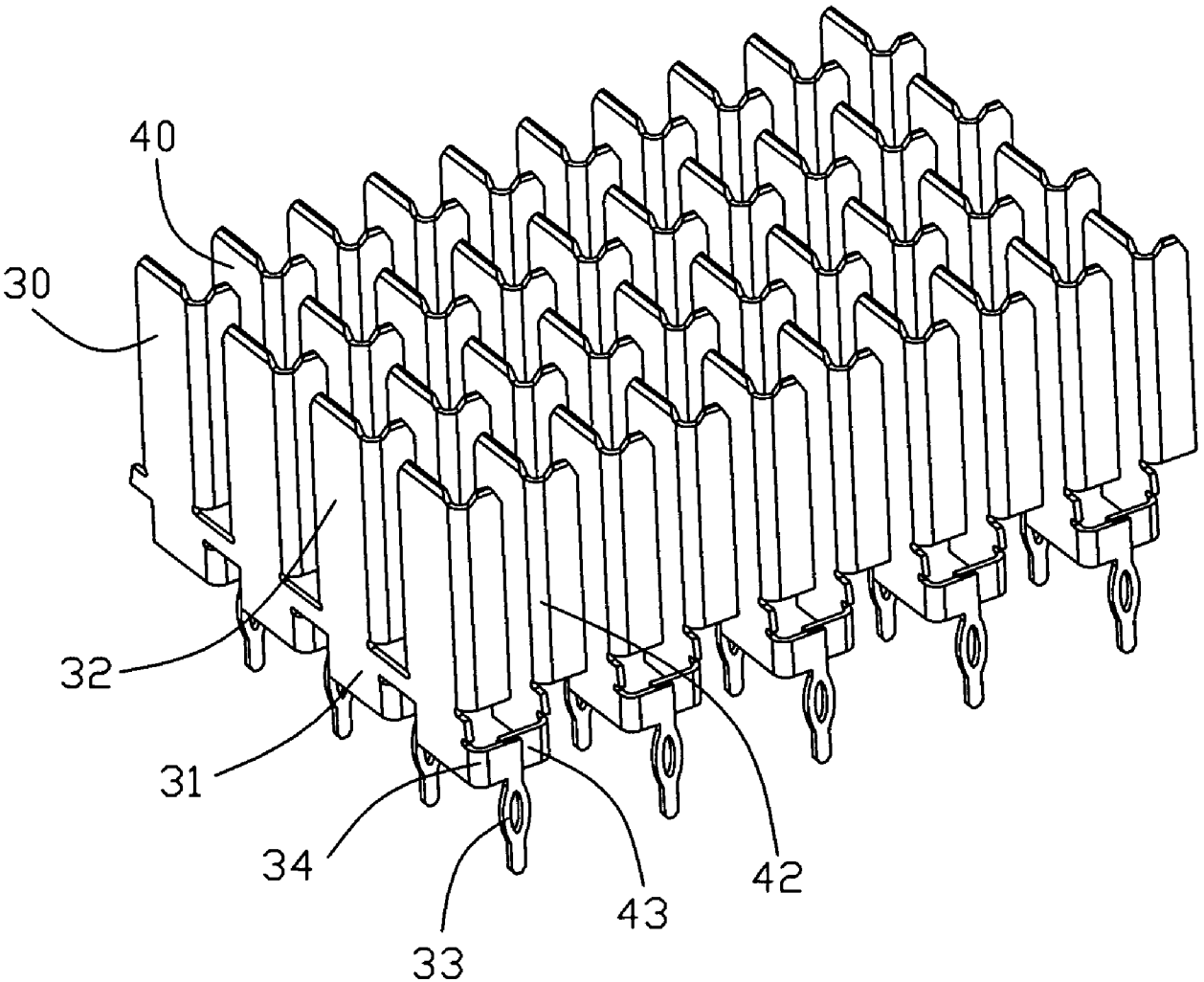
FIG. 5 is an assembled perspective view showing a number of first shielding plates connected with a number of second shielding plate of the electrical connector as shown in FIG. 1.
Figure 6:
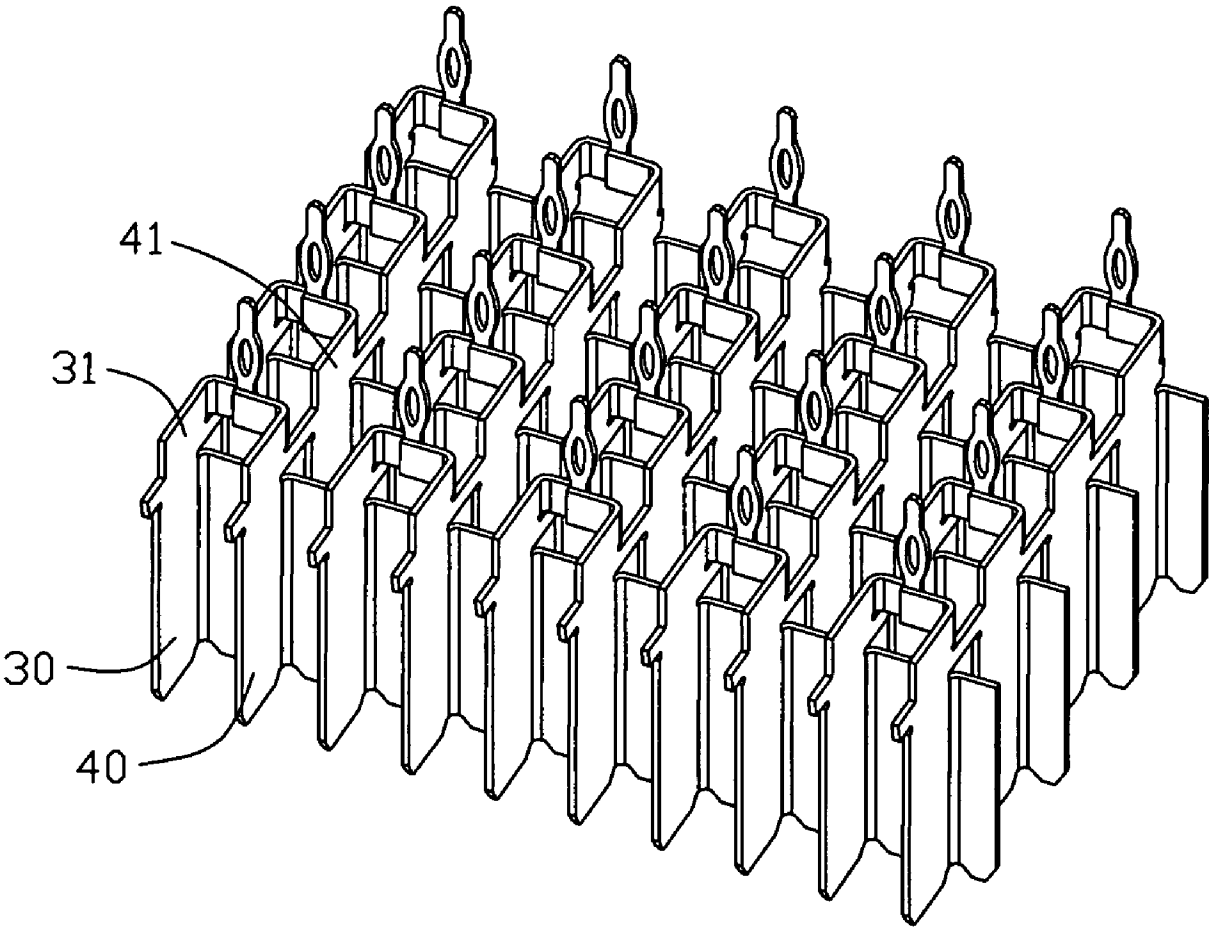
FIG. 6 is an assembled perspective view similar to FIG. 5 taken from another aspect.

Referring to FIGS. 1-2, the insulative base 10 has two opposite lateral walls 11, 12, a bottom wall 13 and a receiving cavity 100 define therebetween for receiving a complementary connector (not shown). The bottom wall 13 has a mating face 131 formed in the receiving cavity 100, and a mounting face 132 formed opposite to the mating face 131 for mounting on a printed circuit board (not shown). The bottom wall 13 has a number of pin-receiving holes 133 extending through the mating face 131 and the mounting face 132. The pin-receiving holes 133 are arranged in pairs in order to fasten corresponding pairs of the pins 20.

The bottom wall 13 also has a number of L-shaped openings 134 defined on the mating face 131. Each L-shaped opening 134 partially surrounds a corresponding pair of the pin-receiving holes 133. The L-shaped openings 134 are arranged in rows and columns to define a pattern or matrix corresponding to the pin-receiving holes 133. Thus, each pair of pin-receiving openings 133 is isolated from adjacent pairs. The bottom wall 13 also has an array of passages 135 defined on the mounting face 132. The passage 135 and the L-shaped opening 134 are partially communicated with each other.

A number of columns of pins 20 received in the insulative base 10. Each column of pins 20 are arranged along a first direction perpendicular to the lateral walls 11, 12 and disposed in pairs to deliver differential signals. The column of pins 20 are disposed adjacent to at least one of the first shielding plate 30 and the second shielding plate 40. Each pin 20 has a mating portion 21 disposed in the receiving cavity 100 of the insulative housing 10 for electrically contacting with the complementary connector, a fastening portion 22 interconnected with the mating portion 21 and fastened in the pin-receiving hole 133, and a tail portion 23 connected to the printed circuit board.

Referring to FIGS. 3-6, the first shielding plates 30 are retained in the insulative base 10 in parallel arrangement. Each first shielding plate 30 extends along the first direction and is disposed adjacent to a column of pins 20. Each first shielding plate 30 has a strip-shaped main portion 31 and a number of L-shaped portions 32 disposed on an upper edge of the main portion 31. The strip-shaped main portion 31 are inserted in the passages 135 of the bottom wall 13. The L-shaped portions 32 are inserted in the L-shaped opening 134 of the bottom wall 13. Each L-shaped portion 32 partially surrounds a pair of the pins 20 in the receiving cavity 100 for isolating the pin pair from adjacent pair. The first shielding plate 30 also has a number of tail portions 33 for attaching to a printed circuit board, and a number of bending portions 34 connecting the main portion 31 and the tail portions 33. The tail portions 33 are disposed between two tail portions 23 of adjacent pairs of pins 20 within the same column of pins 20. The tail portions 33 are connected with grounding traces of the printed circuit board. The first shielding plates 30 are fastened in the passages 135 of the bottom wall 13.

The second shielding plates 40 are retained in the insulative base 10 in parallel arrangement. Each second shielding plate 40 extends along the first direction and is disposed adjacent to the first shielding plates 30. Each second shielding plate 40 is disposed adjacent to a column of pins 20. The second shielding plate 40 has a strip-shaped main portion 41 and a number of L-shaped portions 42 disposed on an upper edge of the main portion 41. The strip-shaped main portion 41 is inserted in the passages 135 of the bottom wall 13. The L-shaped portions 42 are inserted in the L-shaped opening 134 of the bottom wall 13. Each L-shaped portion 42 partially surrounds a pair of the pins 20 in the receiving cavity 100 for isolating the pin pair from adjacent pair. The second shielding plate 40 also has a number of connecting portions 43 formed on a lower edge of the main portion 41. Each connecting portion 43 extends along a direction perpendicular to the first direction and projects to the adjacent first shielding plate 30. The connecting portion 43 is contacted with the bending potion 34 of the first shielding plate 30. Thus, a reliable connection is established between the first shielding plate 30 and the second shielding plate 40. The second shielding plate 30 is electrically connected with the printed circuit board via the grounding tails 33 of the first shielding plate 30.

The first shielding plate 30 having a number of tails portions 33 connected with the second shielding plate 40 having no tail portions. Thus, the number of the grounding paths of the printed circuit board would be reduced.

Other objects, advantages and novel features of the invention will become more apparent from the following detailed description of a preferred embodiment when taken in conjunction with the accompanying drawings.

What is claimed is:

1. An electrical connector comprising:

an insulative base;

a plurality of first shielding plates retained in the insulative base and arranged in parallel arrangement, each first shielding plate extending along a first direction and comprising a plurality of tail portions for attaching to a printed circuit board; and a plurality of second shielding plates retained in the insulative base and arranged in parallel arrangement, each second shielding plate extending along the first direction and disposed adjacent to the first shielding plate, each second shielding plate comprising a plurality of connecting portions connected to the adjacent first shielding plate; and a plurality of columns of pins received in the insulative base, each column of pins arranged along the first direction and disposed between the first shielding plate and the second shielding plate.

2. The electrical connector as claimed in claim 1, wherein said first shielding plate has a main portion and a bending portion connecting the main portion and the tail portion.

3. The electrical connector as claimed in claim 2, wherein each connecting portion of the second shielding plate is electrically connected to the bending portion and therefore to the tail portion of the first shielding plate.

4. The electrical connector as claimed in claim 1, wherein each column of pins are disposed in pairs to deliver differential signals, each pin having a tail portion for attaching to the printed circuit board.

5. The electrical connector as claimed in claim 4, wherein said tail portions of the first shielding plate are disposed between the tail portions of adjacent pairs of pins within the same column of pins.

6. The electrical connector as claimed in claim 4, wherein each of the first and second shielding plates has a main portion and a plurality of L-shaped portions formed on the main portion, each L-shaped portion partially surrounding a pair of pins.

7. The electrical connector as claimed in claim 6, wherein said insulative base has two opposite lateral walls, a bottom wall and a receiving cavity defined therebetween.

8. The electrical connector as claimed in claim 7, wherein said bottom wall has a mating surface, a mounting surface opposite to the mating surface and a plurality of pin-receiving holes extending though the mating surface and the mounting surface.

9. The electrical connector as claimed in claim 8, wherein said bottom wall further has a plurality of L-shaped openings defined on the mating surface for insertion of the L-shaped portions of the shielding plates, each L-shaped opening partially surrounding a corresponding pair of the pin-receiving holes.

10. The electrical connector as claimed in claim 9, wherein said bottom wall further has a plurality of passages defined on the mounting surface for insertion of the main portions of the shielding plates, the passages partially communicating with the L-shaped openings.

* * * * *